US005732461A

United States Patent [19]

Keffeler et al.

[11] Patent Number: 5,732,461

[45] Date of Patent: Mar. 31, 1998

[54] HAND TOOL

[76] Inventors: Gregory T. Keffeler, 8939 "F" St., Omaha, Nebr. 68127; Terry D. Kausch, 6042 S. 38th St., Omaha, Nebr. 68107

[21] Appl. No.: 783,568

[22] Filed: Jan. 15, 1997

[51] Int. Cl.[6] ..... H01R 43/042

[52] U.S. Cl. ..... 029/751; 29/268; 7/107; 72/409.14; 81/421

[58] Field of Search ..... 29/33, 268, 751; 7/107; 72/409.06, 409.14, 712; 81/421, 422, 423; 140/106

[56] References Cited

U.S. PATENT DOCUMENTS

| | | | |
|---|---|---|---|
| D. 245,752 | 9/1977 | Wiener | D8/52 |
| 3,918,472 | 11/1975 | Brown | 140/106 |
| 4,590,786 | 5/1986 | Wiener et al. | 29/751 X |
| 4,736,480 | 4/1988 | Bohl et al. | 7/107 |
| 4,736,614 | 4/1988 | Fryberger | 72/409.14 X |
| 4,868,976 | 9/1989 | Schiller, Sr. et al. | 29/749 |
| 4,995,128 | 2/1991 | Montgomery et al. | 7/127 |
| 5,041,028 | 8/1991 | St ähle | 439/822 |
| 5,042,285 | 8/1991 | Levy | 72/409.14 |
| 5,207,012 | 5/1993 | Lael | 7/106 X |
| 5,211,049 | 5/1993 | Lucas | 29/751 |
| 5,236,631 | 8/1993 | Liu | 72/409.14 X |
| 5,245,721 | 9/1993 | Lowe et al. | 7/107 X |
| 5,428,983 | 7/1995 | Liu | 29/751 X |
| 5,457,876 | 10/1995 | Gerhard, Jr. | 29/751 |

FOREIGN PATENT DOCUMENTS

| | | | |
|---|---|---|---|
| 3825775 | 5/1989 | Germany | 29/751 |

*Primary Examiner*—Peter Vo

*Attorney, Agent, or Firm*—Zarley, McKee, Thomte, Voorhees & Sease; Dennis L. Thomte

[57] ABSTRACT

A hand tool for supporting a jaw-type electrical tap thereon during the positioning of the same with respect to an electrical wire and for clamping the tap thereon comprising a pair of elongated handles which are pivotally secured together and which has a tap support operatively secured thereto. The tap support is designed to be removably connected to the electrical tap so that the electrical tap may be positioned with respect to the electrical wire and clamped thereon by pivotally moving the handles towards one another to cause the jaw members thereof to clamp the tap onto the wire.

4 Claims, 2 Drawing Sheets

HAND TOOL

BACKGROUND OF THE INVENTION

1. Field of the Invention

The present invention relates to a hand tool and more partioularly to a hand tool for supporting a jaw-type electrical tap thereon during the positioning of the same with respect to an electrical wire and for clamping the tap thereon.

2. Description of the Related Art

In many instances, it is desired to install an electrically operated device in an automobile such as an alarm, etc. The alarm normally has one or more electrical leads extending therefrom which must be connected to power supply wires or ground wires located beneath the dash of the automobile so that electrical power may be provided to the alarm. In many cases, a T-tap or tap is clamped onto the power supply wire which is adapted to receive the terminal or contact of the alarm electrical lead so that electrical power may be supplied to the alarm. Inasmuch as the power supply line is located beneath the dash in a fairly inaccessible location, it is difficult to not only position the tap with respect to the power supply line, but it is also difficult to clamp the tap onto the power supply line.

SUMMARY OF THE INVENTION

A hand tool for supporting a jaw-type electrical tap thereon during the positioning of the same with respect to an electrical power supply wire or ground wire and for clamping the tap thereon is described, the hand tool comprising a first handle having a first jaw at one end thereof and a second handle having a second jaw at one end thereof. A pivot pin connects the first and second handles together so that the first and second jaws may be moved towards one another or moved away from one another. A tap support is positioned between the first and second jaws and is operatively secured to one of the handles or the pivot pin so that the tap support may be removably attached to the electrical tap to be installed on the electrical power supply line or ground wire, when the jaws are separated, to enable the electrical tap to be positioned around the wire, and then clamped onto the wire, as the jaws are moved towards one another. The tap support is removably attached to the electrical tap so that the tap support may be disconnected therefrom after the electrical tap is clamped onto the electrical power supply wire or ground wire.

It is therefore a principle object of the invention to provide a tool for supporting an electrical tap thereon during the positioning of the tap with respect to a power supply line and for clamping the tap thereon.

Yet another object of the invention is to provide a device of the type described which is convenient to use.

Still another object of the invention is to provide a device of the type described which is economical of manufacture and durable in use.

These and other objects will be apparent to those skilled in the art.

DESCRIPTION OF THE PREFERRED EMBODIMENT

Figure 1:
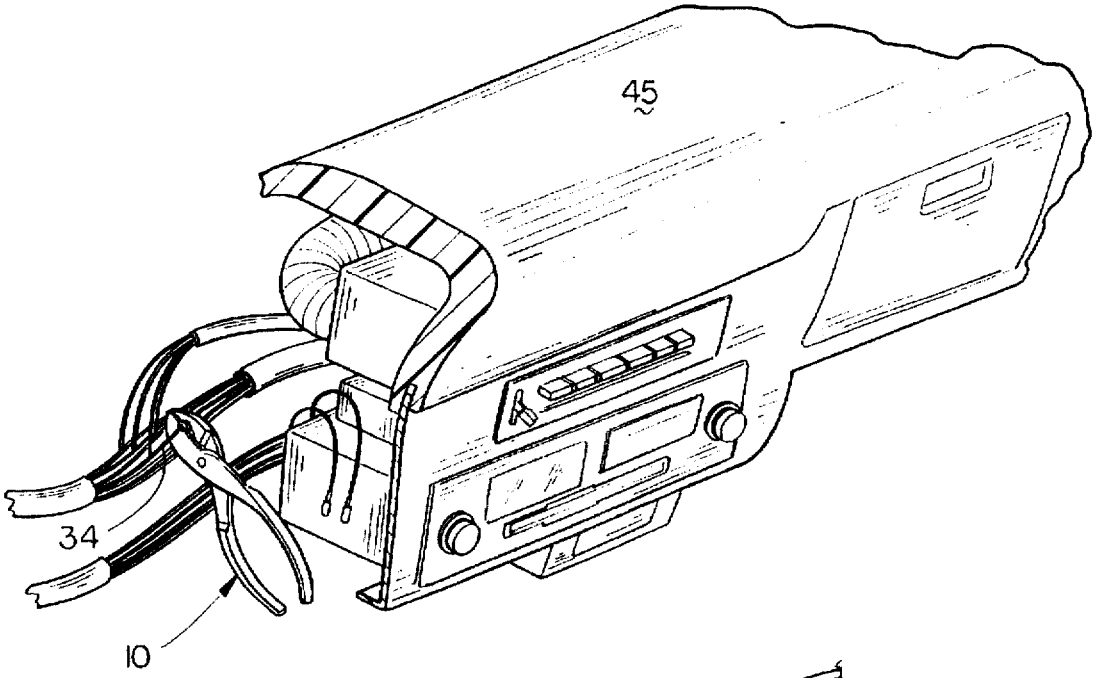
FIG. 1 is a partial perspective view of an automobile dash, the electrical wires located therein, and the tool of this invention.
Figure 2:
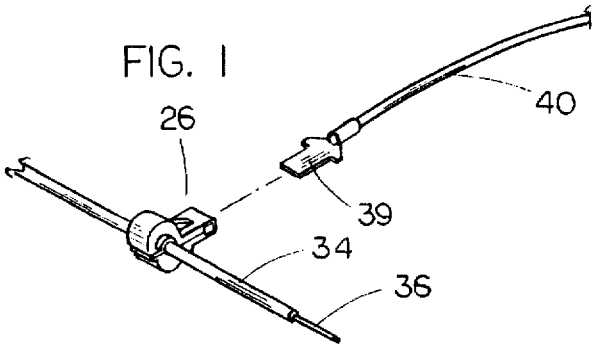
FIG. 2 is a perspective view of an electrical tap clamped onto an electrical wire and the electrical lead extending from the alarm or the like which is being installed in the vehicle.

The hand tool of this invention is referred to generally by the reference numeral 10 and is of the pliers type. Tool 10 includes a first elongated handle 12 having a first jaw 14 at one end thereof. Tool 10 also includes a second elongated handle 16 having a second jaw 18 at one end thereof. Handles 12 and 16 are pivotally secured together by pivot pin 20 extending therethrough in conventional fashion. Preferably, jaws 14 and 18 have an inner surface configuration which is complementary in shape to the exterior surfaces of jaws 22 and 24 of electrical tap 26.

Electrical tap 26 is of the conventional type including jaws 22 and 24 hinged together at 28 which define an opening 30 therebetween. Tap 26 includes a terminal positioned on one of its jaws which is adapted to pierce the insulation of the electrical wire 34 being tapped and to make electrical contact with the conductor wire 36 therein. Wire 34 is normally a power supply line, but could be a ground wire in some cases. Tap 26 has a U-shaped portion 38 at one end thereof which is adapted to receive a connector or terminal spade 39 extending from the wire 40, which is to be tapped into the wire 34, through an opening formed in the end of the tap 26. Tap 26 includes latching elements 42 and 44 on the outer ends of jaws 22 and 24 to maintain the tap 26 on the wire 34 once the jaws 22 and 24 have been closed to create the desired electrical connection.

Figure 3:
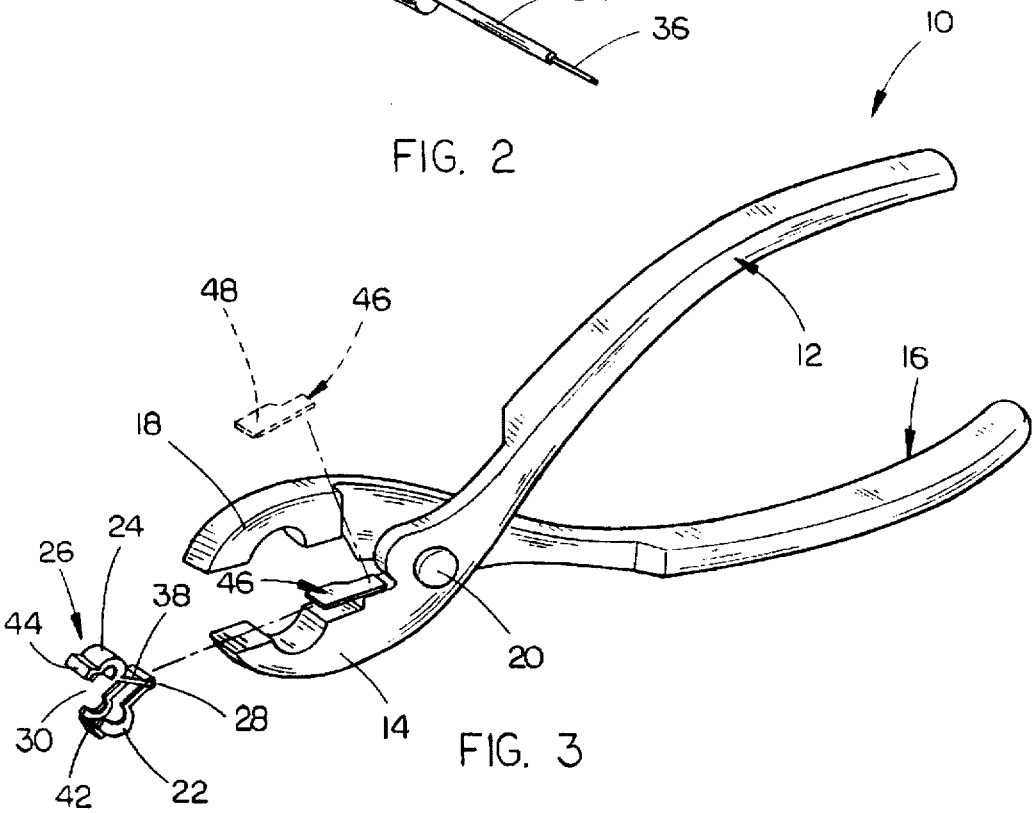
FIG. 3 is a perspective view of the hand tool of this invention.
Figure 4:
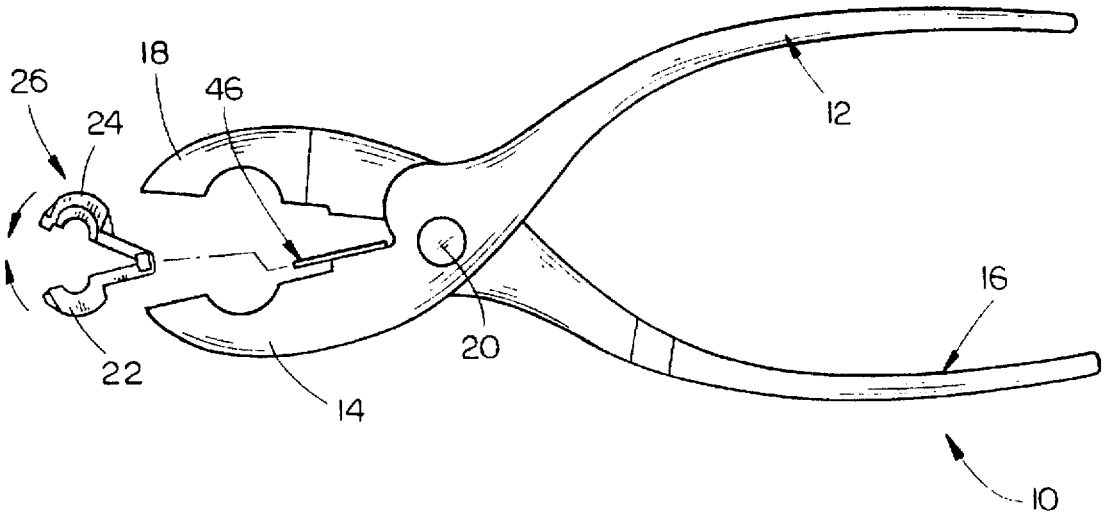
FIG. 4 is a side view of the hand tool of this invention.
Figure 5:
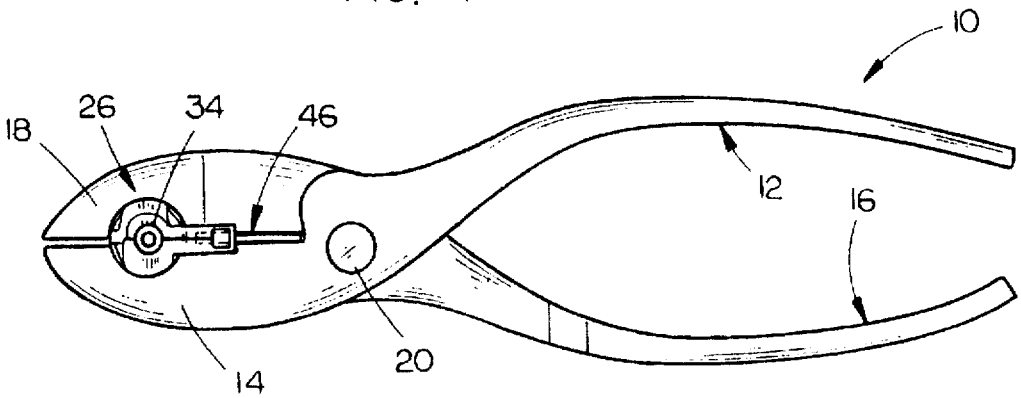
FIG. 5 is a view similar to FIG. 4 except that the tap has been clamped onto an electrical power supply wire or the ground wire.

Frequently, the wire 34 to be tapped is located in an inconvenient location, such as beneath the dash 45 of an automobile. In such a location, it is difficult to properly position the tap 26 around the wire 34 and then clamp the tap 26 onto the wire 34. The tool 10 of this invention makes the tapping operation much more readily attainable. To this end, a tap support 46 is secured to the tool 10. In one form of the invention, as seen in FIGS. 3–5, the tap support 46 is secured to one of handles 12 and 16, by any conventional means, so that the tap supporting end thereof is preferably positioned between the jaws 14 and 18 of tool 10. The tap supporting end of tap support 46 is preferably provided with a spade-like device 48 which is adapted to be inserted into the opening of tap 26, which is designed to receive the spade or terminal 39, to positively maintain the tap 26 between the jaws 14 and 18 during the positioning of the tap 26 with respect to the wire 34. Further, while it is preferred that device 48 be of the same design as the spade 39, it may be possible to vary the design thereof as long as the proper support is achieved.

Figure 6:
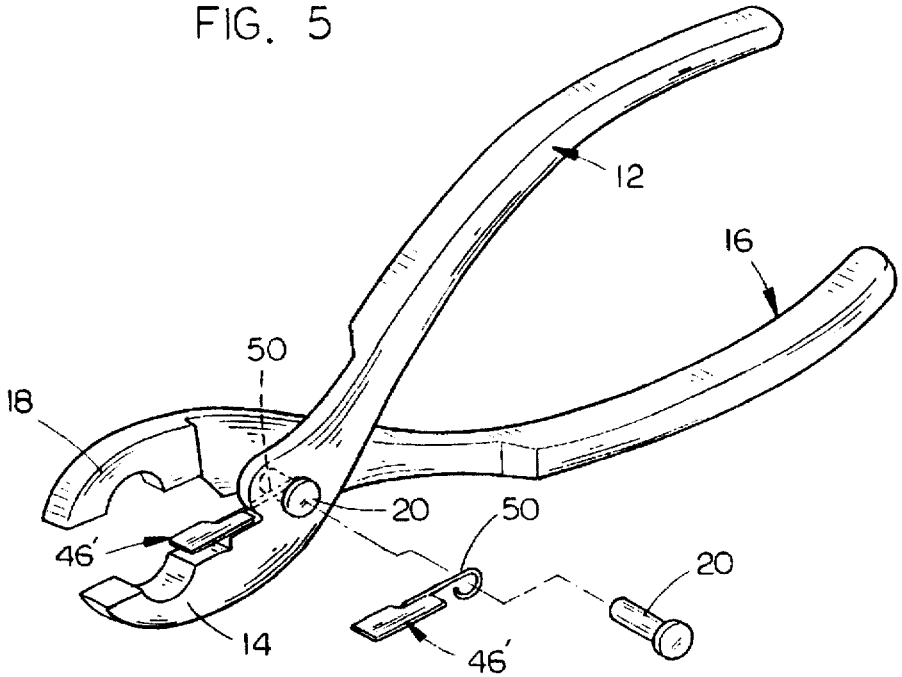
FIG. 6 is a perspective view of a modified form of the invention.

In another form of the invention, the tap support 46' is secured to the tool 10 by means of an elongated wire 50 or the like which is operatively secured to the pivot pin 20, as seen in FIG. 6.

Thus, when it is desired to install a tap 26 on the wire 34, a tap 26, having its jaws separated, is placed between jaws 14 and 18 of tool 10. The device 48 of tap support 46 is inserted through the opening of the tap 26 which is designed to receive the terminal 39. The handles 12 and 16 are then held by the installer and maneuvered so that the jaws 22 and 24 of the tap 26 are properly positioned around the wire 34. During the positioning of the tap 26 with respect to the wire 34, the tap 26 remains between the jaws 14 and 18 of tool 10 due to its connection with the tap support 46.

When tap 26 is properly positioned, the handles 12 and 16 are moved towards one another to close jaws 14 and 18 to clamp tap 26 onto wire 34 and to create the desired electrical connection therebetween. Once the tap 26 has been clamped onto the wire 34, tool 10 is pulled away from the wire 34 which will cause device 48 to disconnect from tap 26. The spade 39 of wire 40 is then inserted into the tap 26 to electrically connect wire 40 to wire 34.

Thus it can be seen that a novel tap supporting and clamping tool has been provided which accomplishes at least all of its stated objectives.

We claim:

1. A hand tool for supporting a jaw-type electrical tap thereon during the positioning of the same with respect to an electrical wire and for clamping the tap thereon, said tap having a rectangular cavity formed therein for receiving a flat electrical terminal therein, comprising:

a first elongated handle having a first jaw at one end thereof;

a second elongated handle having a second jaw at one end thereof;

pivot means pivotally connecting said first and second handles whereby said first and second jaws may be moved towards one another or moved away from one another;

a flat tap support at least partially positioned between said first and second jaws and being operatively secured to one of said handles whereby said flat tap support may be removably inserted into said rectangular cavity in said electrical tap, when said jaws are separated, to enable the electrical tap to be positioned around the electrical wire, and then clamped onto the electrical wire as said jaws are moved towards one another;

said flat tap support being removably attached to said electrical tap so that said flat tap support may be disconnected therefrom after the electrical tap has been clamped onto the electrical wire.

2. The tool of claim 1 wherein said flat tap support includes first and second ends, said first end of said flat tap support being secured to said one handle and extending therefrom so that its said other end is positioned between said jaws.

3. A hand tool for supporting a jaw-type electrical tap thereon during the positioning of the same with respect to an electrical wire and for clamping the tap thereon, said tap having a rectangular cavity formed therein for receiving a flat electrical terminal therein, comprising:

a first elongated handle having a first jaw at one end thereof;

a second elongated handle having a second jaw at one end thereof;

pivot means pivotally connecting said first and second handles whereby said first and second jaws may be moved towards one another or moved away from one another;

a flat tap support positioned between said first and second jaws and being operatively secured to said pivot means whereby said flat tap support may be removably inserted into said rectangular cavity in said electrical tap to be installed on the electrical wire, when said jaws are separated, to enable the electrical tap to be positioned around the electrical wire, and then clamped onto the electrical wire as said jaws are moved towards one another.

4. The tool of claim 3 wherein said flat tap support includes first and second ends, said first end of said tap support being secured to said pivot means and extending therefrom so that its said other end is positioned between said jaws.

* * * * *